US006418821B1

(12) United States Patent
Yamakawa

(10) Patent No.: US 6,418,821 B1
(45) Date of Patent: Jul. 16, 2002

(54) WORKING TOOL

(75) Inventor: Masahiko Yamakawa, Sakai (JP)

(73) Assignee: Sangadensetsukogyo Co., Ltd., Osaka (JP)

( * ) Notice: Subject to any disclaimer, the term of this patent is extended or adjusted under 35 U.S.C. 154(b) by 0 days.

(21) Appl. No.: 09/578,423

(22) Filed: May 25, 2000

Related U.S. Application Data

(63) Continuation of application No. PCT/JP98/05395, filed on Nov. 30, 1998.

(30) Foreign Application Priority Data

Nov. 28, 1997 (JP) ..... 9-327350
Nov. 28, 1997 (JP) ..... 9-327351
May 15, 1998 (JP) ..... 10-133037

(51) Int. Cl.[7] ..... B25F 1/00
(52) U.S. Cl. ..... 81/437; 81/125.1; 81/124.6
(58) Field of Search ..... 81/437, 438, 121.1, 81/125.1, 124.5, 124.6, 177.2

(56) References Cited

U.S. PATENT DOCUMENTS 1,281,438 A * 10/1918 Tuttle ..... 81/124.5
2,453,901 A * 11/1948 Gonsett et al. ..... 7/138
3,452,373 A * 7/1969 Vosbikian et al. ..... 7/138
5,048,379 A * 9/1991 Gramera et al. ..... 81/124.4
5,309,798 A * 5/1994 Markwart et al. ..... 81/438
5,481,949 A * 1/1996 Yen ..... 81/438
5,752,418 A * 5/1998 Robins ..... 81/177.2

FOREIGN PATENT DOCUMENTS

| | | |
|---|---|---|
| JP | 48-45296 | 6/1973 |
| JP | 49-75500 | 6/1974 |
| JP | 61-24165 | 2/1986 |
| JP | 62-159285 | 10/1987 |
| JP | 2-100783 | 10/1990 |

* cited by examiner

*Primary Examiner*—Joseph J. Hail, III
*Assistant Examiner*—David B. Thomas
(74) *Attorney, Agent, or Firm*—Schweitzer Cornman Gross & Bondell LLP

(57) ABSTRACT

A socket tool for alternative use in combination with a screw driver or a conventional wrench. A socket body is formed so as to fit externally over a driver bit and is movable axially therealong and is detachable therefrom but is non-rotatable relative to the driver bit over its length. Socket portions are provided on opposite end portions of the socket body, with internal dimensions different from one another. Outer peripheries of the socket portions at both ends of the socket body are formed into regular polygonal shapes in cross section and serve as external drive engaging faces, to be engaged externally by the wrench. The outer peripheries of both the socket portions have external diameters different from one another. The socket tool is held alternatively on either the driver bit or the wrench, with one of the socket portions engaging the driver bit or wrench and the other socket portion projecting longitudinally away therefrom.

3 Claims, 9 Drawing Sheets

WORKING TOOL

RELATED APPLICATIONS

This application is a continuation of PCT/JP98/05395 filed Nov. 30, 1998, published Jun. 10, 1999 (WO 99/28076).

TECHNICAL FIELD

The present invention relates to a working tool which can be used for engaging and disengaging of a bolt and nut by mounting on a driver bit or a socket of a driver.

BACKGROUND ART

Conventionally, as a working tool such as typically used driver or the like, there is a fixed type driver, in which a driver bit is integrally mounted on a handle (grip portion), or an exchangeable driver, in which several kinds of driver bits are detachably mounted to a common handle, and so forth. Either driver cannot be used other than driving a screw.

A primary object of the present invention is to provide a working tool which can be used as a socket wrench for engaging and disengaging bolt and nut, by mounting on a driver as set forth above.

DISCLOSURE OF THE INVENTION

A working tool of the invention as defined in claim 1, formed by externally fitting a socket body 2 which is movable in an axial direction along an outer periphery of a driver bit 11, detachable from the driver bit 11 and being non-rotatable over the entire range of axial direction, on the driver bit 11, and forming socket portions 3, 4 at both end portions of the socket body 2.

With the invention as defined in claim 1, a socket body which is movable in axial direction along the driver bit and is detachable but non-rotatable, is externally fitted on the driver bit to form socket portions at both ends of the socket body. Therefore, by simply externally fitting the socket body on the driver bit, the driver can be effectively used as a socket wrench.

The working tool of the invention can be simply used by mounting on a typical driver, such as a fixed type driver, in which the driver bit is integrally mounted on a handle, an exchangeable type driver, in which the driver bit is detachably mounted on the handle or so forth. Furthermore, since the construction is simple and formed with single hollow shaft like body, it can be manufactured at low cost and is convenient for carrying.

On the other hand, when the socket body is mounted on the driver to perform tightening operation of the bolt which enables wrenching off by applying a wrenching torque, the socket portion of the socket body is engaged with the head portion of the bolt to tighten, or loosen the bolt, and thereafter push out the head of the bolt locked in the socket portion by a handle of the driver. Thus, the bolt head can be easily removed.

Since the socket body is externally fitted on the driver bit over the entire range in the axial direction, even when the socket body is shifted to either position of the driver bit, the socket body will not cause lost motion.

In the tool of the invention, the socket body, which is movable in axial direction along the driver bit and is detachable but non-rotatable, is externally fitted on the driver bit to form socket portions at both ends of the socket body. Therefore, by simply externally fitting the socket body on the driver bit, the driver can be effectively used as a socket wrench and is applicable to large and small 2 kinds of bolt/nut sizes by both socket portions having different internal diameters formed at both end portions.

In the working tool of the invention, engaging means 5 engageable with an engaging recess portion 11*b* formed on the outer periphery of the driver bit 11 is provided in the socket body 2, whereby the socket body 2 is held on the driver bit 11 in a position where each socket portion 3, 4 can be used. The socket body can be held on the driver bit at the position where each socket portion can be used by providing the engaging means engageable with the engaging recess portion formed on the outer periphery of the driver bit. By this, upon use, the socket body does not move to make operation easier. On the other hand, upon carrying, the socket does not fall off the driver bit. Thus, the socket can be always mounted on the driver bit to provide good portability.

Advantageously, in the working tool defined in claim 3, the engaging means 5 comprises a spherical body 7 inserted and arranged within a window 6 provided at a predetermined position of the socket body 2, and a spring 8 biasing the spherical body 7 to engage with the engaging recess portion 11*b* of the driver bit 11 by projecting inwardly from the window 6. By forming the engaging means with the spherical body inserted, arranged within the window provided in the socket body, and the spring biasing the spherical body to project inwardly from the window to engage with the engaging recess portion of the driver bit, the socket body can be positively held at the predetermined position on the driver bit to make construction simple and manufacturing easy.

BEST MODE FOR IMPLEMENTING THE INVENTION

Figure 1:
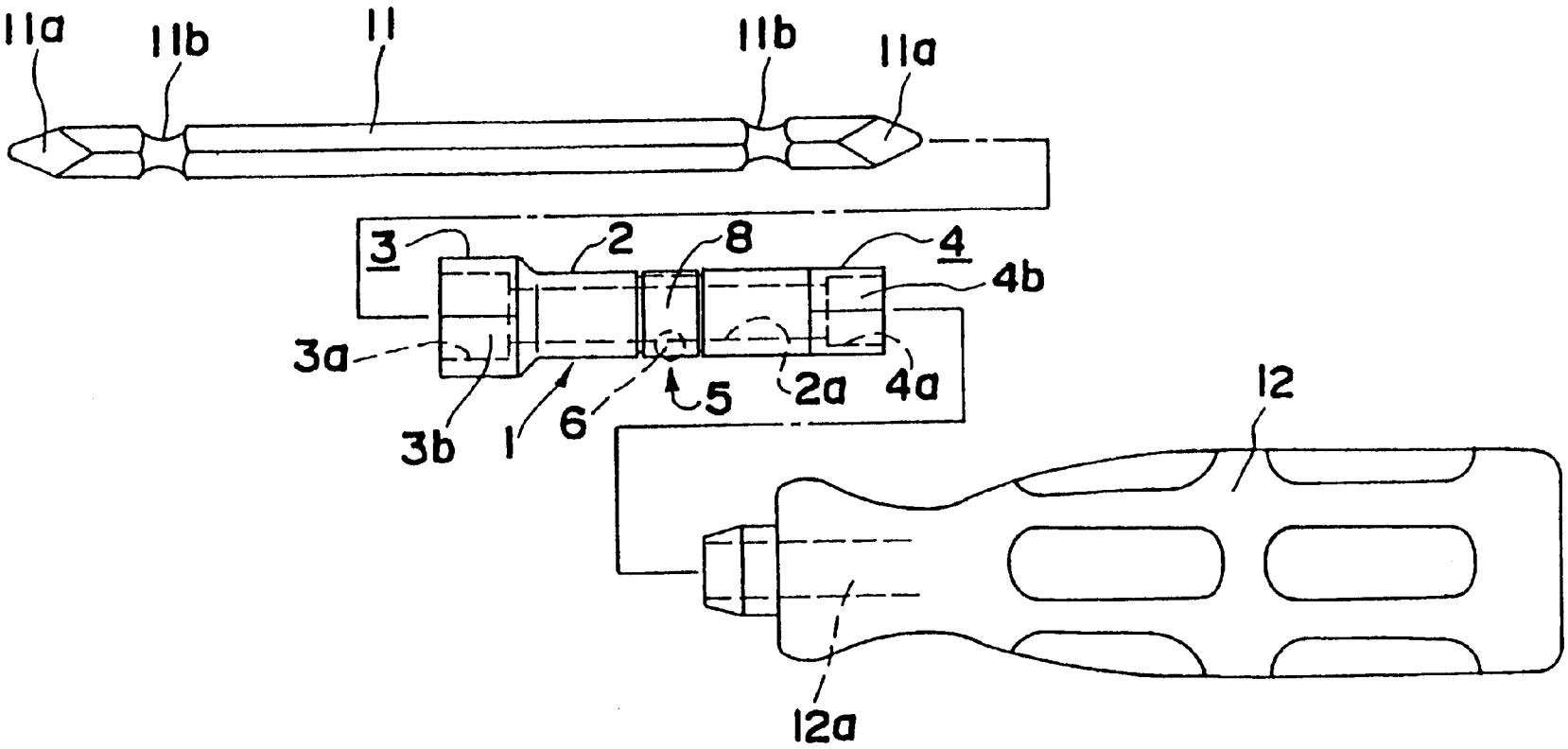
FIG. 1 is an exploded view showing a driver bit and a handle forming a driver and working tool according to the present invention to be mounted on the driver bit.
Figure 2:
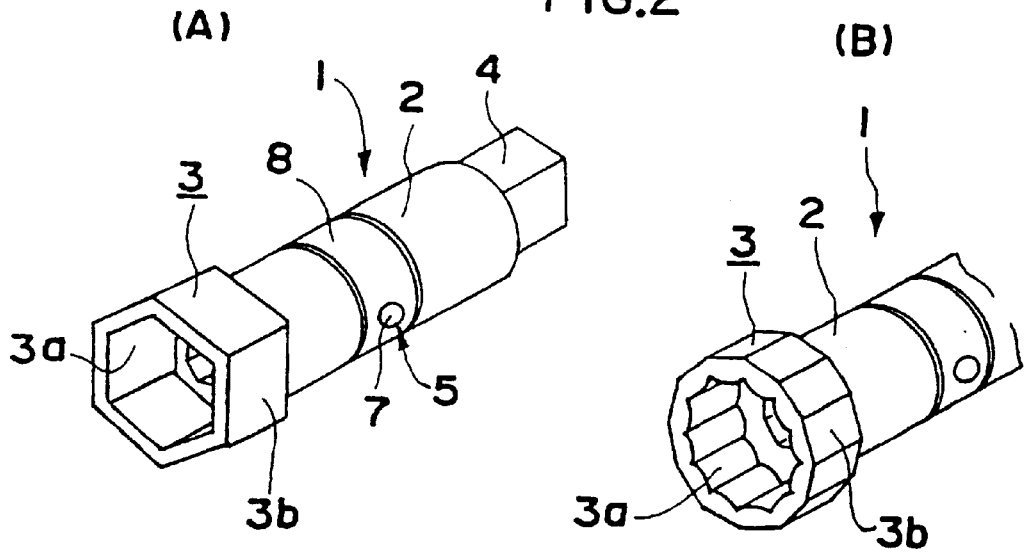
FIG. 2(A) is an external perspective view of a working tool, in which each socket portion is hexagonal shaped configuration, 2(B) is an external perspective view of a working tool, in which each socket portion is dodecagonal shaped configuration.
Figure 3:
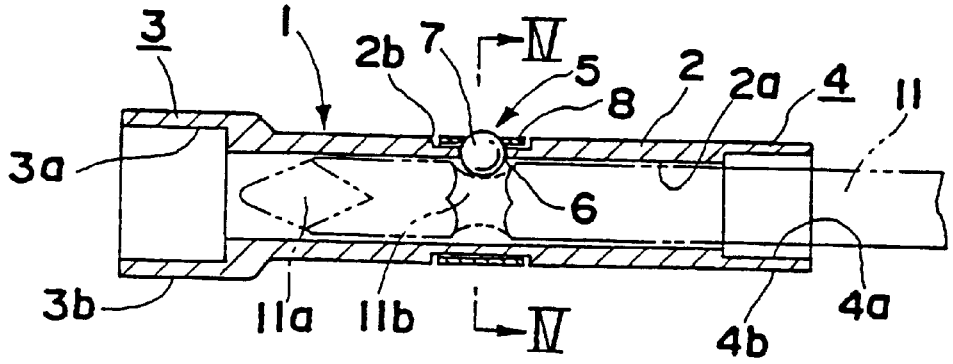
FIG. 3 is a longitudinal section of the working tool.
Figure 4:
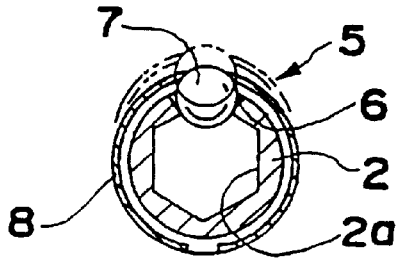
FIG. 4 is an enlarged section taken along line IV—IV of FIG. 3.

FIG. 1 shows a condition where a driver bit 11 and a handle (grip portion) 12 forming an exchange type driver 10 (FIG. 5) used conventionally, and a socket 1 for the driver to be mounted on the driver bit 11 according to the present invention are aligned, FIG. 2 is an external perspective view of the socket 1 for the driver, FIG. 3 is a longitudinal section of the socket 1, and FIG. 4 is a cross section thereof. The driver bit 11 of the driver 10 is a Phillips screwdriver bit, for example, in which both ends 11*a*, 11*a* are formed into crucial shape, and a portion between both ends 11*a*, 11*a* has a hexagonal cross section. On rear side portion of each crucial end portions 11*a*, an engaging recess 11*b* of arc-shaped cross section is extended circumferentially. The handle 12 has an insertion bore portion 12*a*, into which the end portion of the driver bit 11 is inserted in a length of one third of the overall length in non-rotatable and releasable fashion.

The driver socket 1 has a socket body 2 which is externally engaged with the driver bit 11 of the driver in such a manner that it is movable in axial direction along the outer periphery of the driver bit 11 and is releasable from the driver bit 11 but is non-rotatable. On both end portions of the socket body 2, socket portions 3 and 4 are provided. Both socket portions 3 and 4 are formed to have mutually different internal diameter. An inner periphery 2*a* of the socket body 2 is formed into hexagonal cross section (see FIG. 4) so as to be movable in the axial direction in non-rotatable condition.

Internal peripheries 3*a* and 4*a* and external peripheries 3*b* and 4*b* of both socket portions 3 and 4 are formed into hexagonal shape as shown in FIG. 2(A), into dodecagonal shape as shown in FIG. 2(B) or, in the alternative, into quadrangular shape, octagonal shape or regular polygonal shape. On the other hand, the external peripheries 3*b* and 4*b* of both socket portions 3 and 4 are formed to have mutually different external diameter.

On the other hand, at the center portion in the longitudinal direction of the socket body 2, an engaging means 5 which can engage with an engaging recess portions 11*b* respectively formed on the outer periphery of both end portions of the driver bit 11. The engaging means 5 is for positioning the socket body 2 at the predetermined position on the driver bit 11, namely at a position enabling use of the socket portions 3 and 4 and holding in place. As shown in FIGS. 3 and 4, the engaging portion 5 is formed with a spherical body 7 inserted and arranged within a window 6 provided at a predetermined portion in the central portion in the longitudinal direction of the socket body 2, and a substantially C-shaped ring like spring 8 externally fitted on the socket body 2 in the condition partly engaged with the spherical body 7 and biasing the spherical body 7 for inwardly projecting from the window 6 to engage with the engaging recess portion 11*b* of the driver bit 11. It should be noted that the spring 8 normally engages with a shallow circumferential groove 2*b* formed on the outer peripheral surface of the socket body 2.

Accordingly, upon externally engaging the socket body 2 of the driver socket 1 with the driver bit 11, the spherical body 7 is pushed outside of the window 6 against the ring like spring 8 as shown by phantom line of FIG. 4 by the outer peripheral surface of the bit upon initial stage of fitting. However, as engaged with the engaging recess portion 11*b* of the bit 11, the spherical body 7 is held at the position engaging with the engaging recess portion 11*b* by the biasing force of the spring 8 as shown by solid line in FIGS. 3 and 4. Thus, the socket 1 is held in a position where one socket portion 3 can be used.

Figure 5:
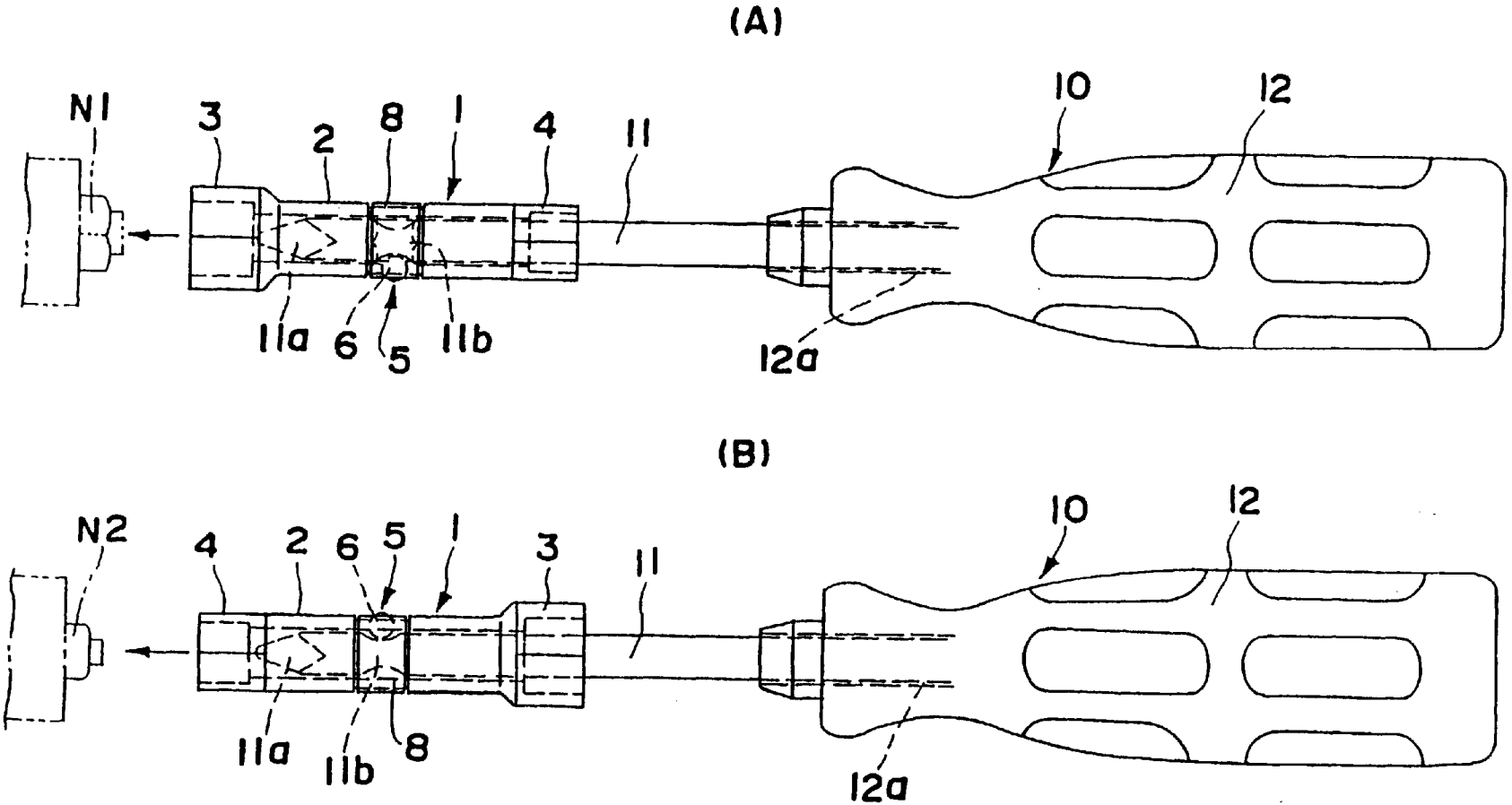
FIG. 5(A) is a plan view showing a use condition of the working tool in the case where a large diameter socket of the working tool is used, and 5(B) is a plan view showing a use condition of the working tool in the case where a small diameter socket of the working tool is used.

FIG. 5 shows a use method of the driver socket 1 constructed as set forth above. FIG. 5(A) shows the case where the large diameter socket portion 3 having larger hole diameter among both socket portions 3 and 4 of the socket 1 is used as the wrenching socket. Namely, in this case, after fixing one end side of the driver bit 11 by inserting into the insertion bore portion 12*a* of the handle 12, the driver socket 1 is externally fitted from the side of small diameter socket portion 4 on the other end of the bit 11 to hold the socket 1 on the bit 11 at the position enabling use of the socket portion 5 by the engaging means 5 to be placed in the illustrated condition. Thus, from this condition, by gripping the handle 12 of the driver 10 and engaging the large diameter socket portion 3 of the socket 1 held on the driver bit 11 with a mounting nut N1 of the corresponding diameter, tightening and releasing operation of the nut N1 can be performed.

FIG. 5(B) shows the case where the small diameter socket portion 4 of the socket 1 is used as the wrenching socket. In this case, the socket 1 mounted on the driver bit as shown in FIG. 5(A) is withdrawn once from the bit 11. The socket 11 is externally fitted on the bit 11 from the large diameter socket portion 3 to alternately fit to the position for enabling use of the small diameter socket portion 4 and hold the socket on the bit 11 by the engaging means 5. Thus, from this condition, by gripping the handle 12 of the driver 10 similar to FIG. 5(A) and engaging the large diameter socket portion 3 of the socket 1 held on the driver bit 11 with a mounting nut N2 of the corresponding diameter, tightening and releasing operation of the nut N2 can be performed.

Figure 6:
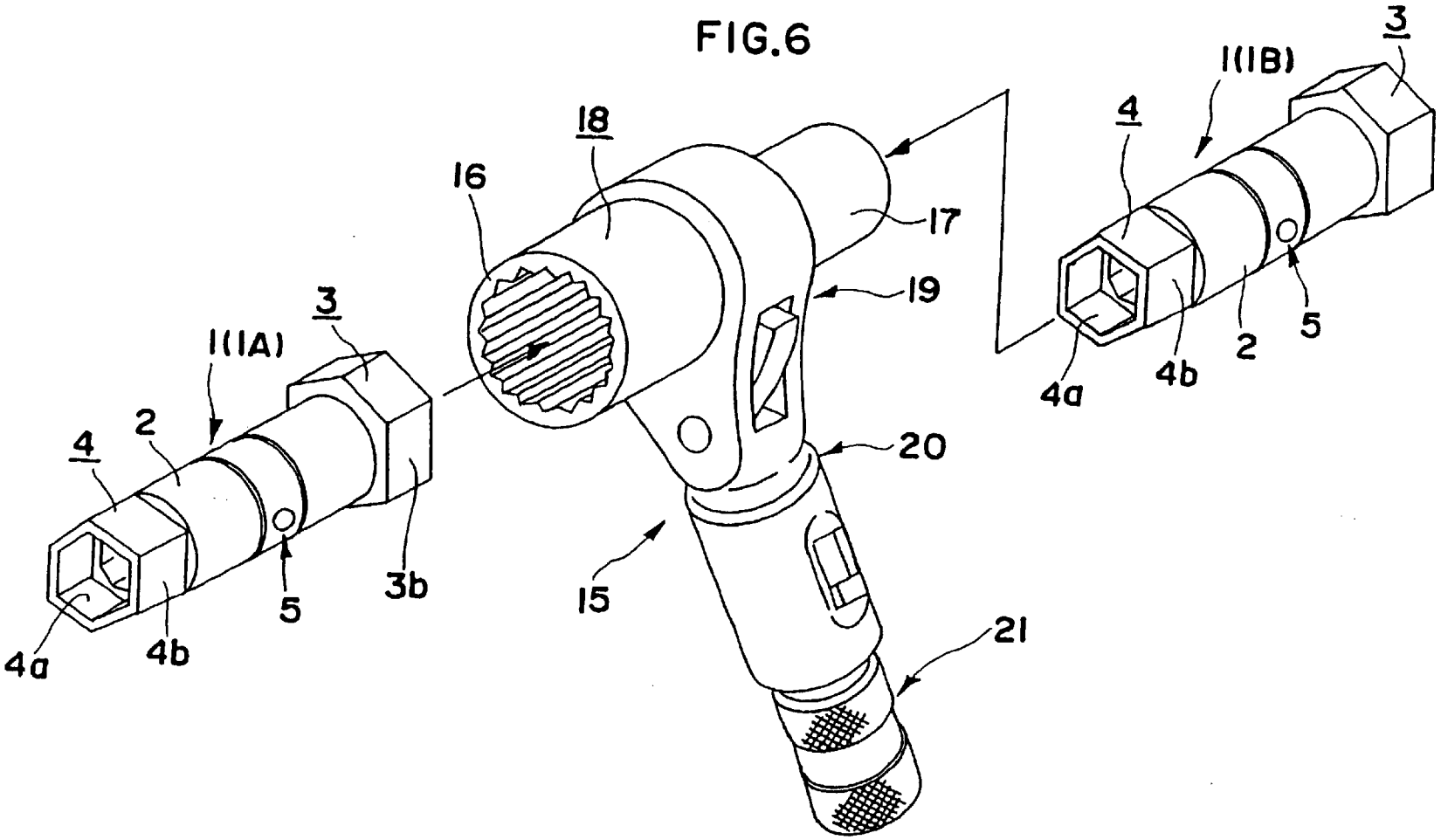
FIG. 6 is an exploded perspective view in the case where the working tool is mounted on a T-shaped socket wrench.
Figure 7:
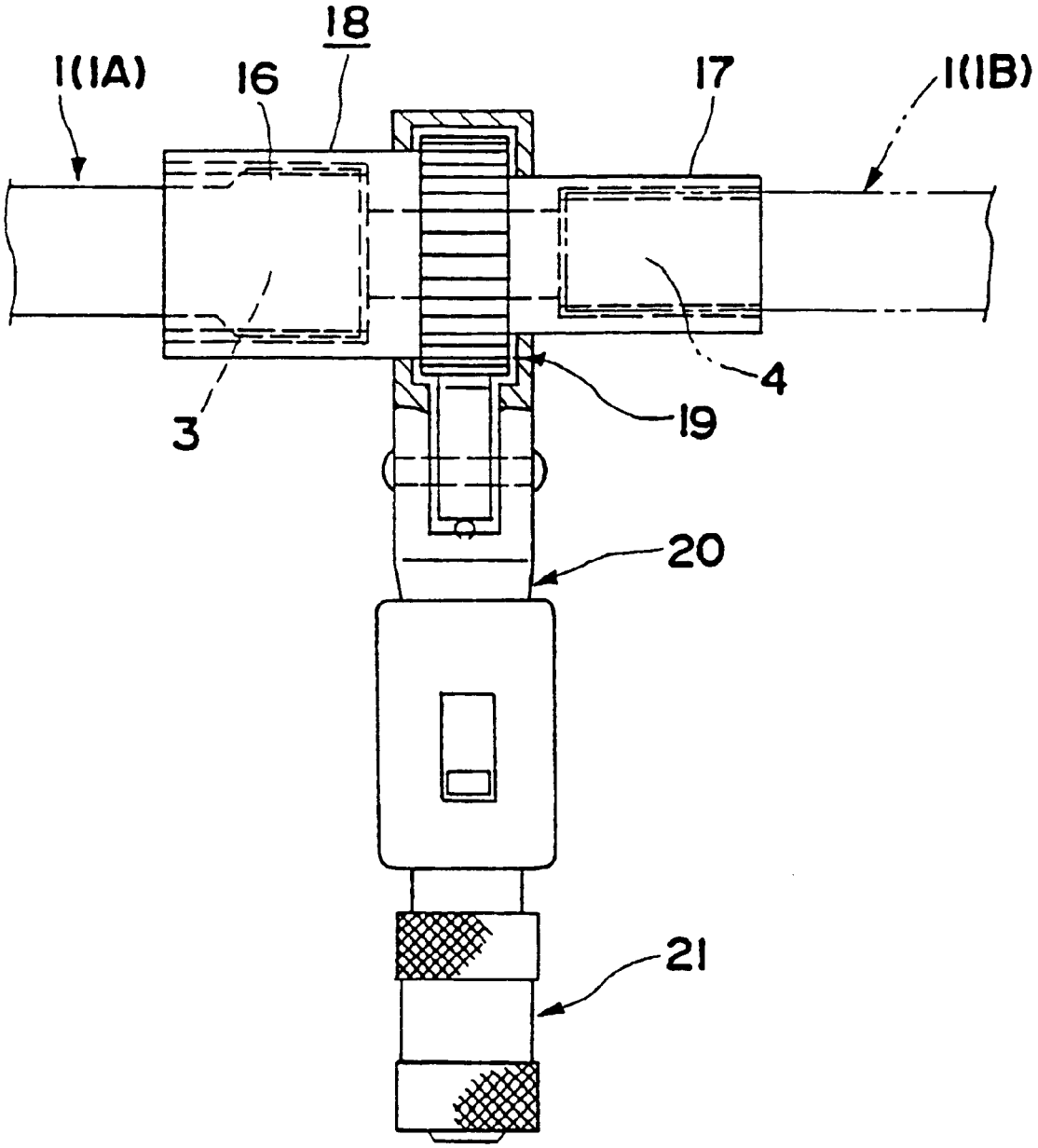
FIG. 7 is a front elevation showing a condition showing mounting condition of the T-shaped socket wrench and the socket in case of FIG. 6.

FIGS. 6 and 7 show the case where the driver socket 1 according to the present invention is mounted on the socket portion of a T-shaped working tool 15 to use as a long socket. The working tool 15 is known one having both of socket wrench function and driver function and has socket 18 formed with socket portions 16 and 17 with mutually different diameter at both end portions. The socket 18 is connected to a socket arm 20 via a wrenching latchet mechanism 19. To this arm 20, a driver bit holder 21 is connected with a driver latchet mechanism (not shown). To the holder 21, the driver bit can be releasably inserted. The large diameter socket portion 16 and the small diameter socket portion 17 have inner peripheries formed into polygon shape. In the large diameter socket portion 16, the large diameter socket portion 3 of the driver socket of the present invention is internally fitted in non-rotatable fashion, and in the small diameter socket portion 17, the small diameter socket portion 4 of the driver socket 1 is internally fitted in non-rotatable fashion. Accordingly, in this embodiment, for the socket 18, one socket 1 forms a second socket 1A and the other socket 1 forms a third socket 1B.

Therefore, when the small diameter socket portion 4 of the driver socket 1 is used, the large diameter socket portion 3 of the socket 1 may be internally fitted to the large diameter socket portion 16 of the T-shaped working tool 15 as shown on left side of FIGS. 6 and 7 respectively. On the other hand, when the large diameter socket portion 3 of the socket 1 is used, the small diameter socket portion 4 of the socket 1 is internally fitted to the small diameter socket portion 17 of the T-shaped working tool 15 as shown on right side of FIGS. 6 and 7 respectively. Accordingly, use as such long socket is quite convenient in the case where the nut or the bolt head to be tightened and released is placed at deep position. It should be noted that the first socket 1A and the second socket 1B are not limited to those having the same internal diameter at both ends, but can be one, in which the internal diameters at both ends of the socket 1A are respectively different internal diameters of the second socket 1B.

On the other hand, the driver socket 1 of the present invention is not specified to the T-shaped working tool as set forth above, but is applicable for the sockets of other variation socket wrenches for use as the long socket.

Figure 8:
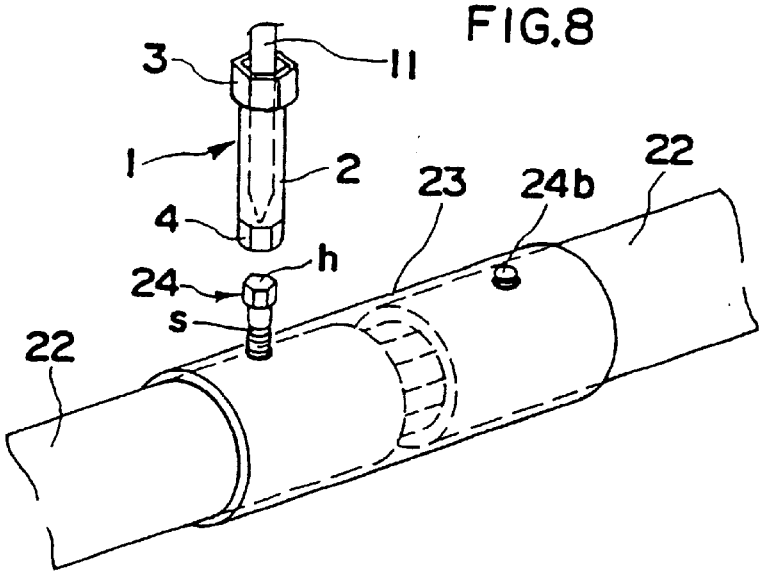
FIG. 8 is a perspective view showing an example of wrenching off of bolt by the working tool.

FIG. 8 shows an example of use of the driver socket 1 to be used for wrenching off of a fastening bolt 24 which fastens a coupling 23 externally fitted onto a piping 22, on the piping 22, upon connecting the pipes 22, 22 of an electric cable wiring, for example. Namely, on the bolt 24, a cut out portion s for wrenching off is formed on a neck portion. After fixing the coupling 23 to the piping 22 by tightening the bolt 24, in order to remove a head portion side 24*a* of the bolt to be unnecessary projecting portion projecting on the surface side of the piping 22, wrenching off torque is applied to the bolt 24 to performing operation to wrenching off the head side 24*a*.

Figure 9:
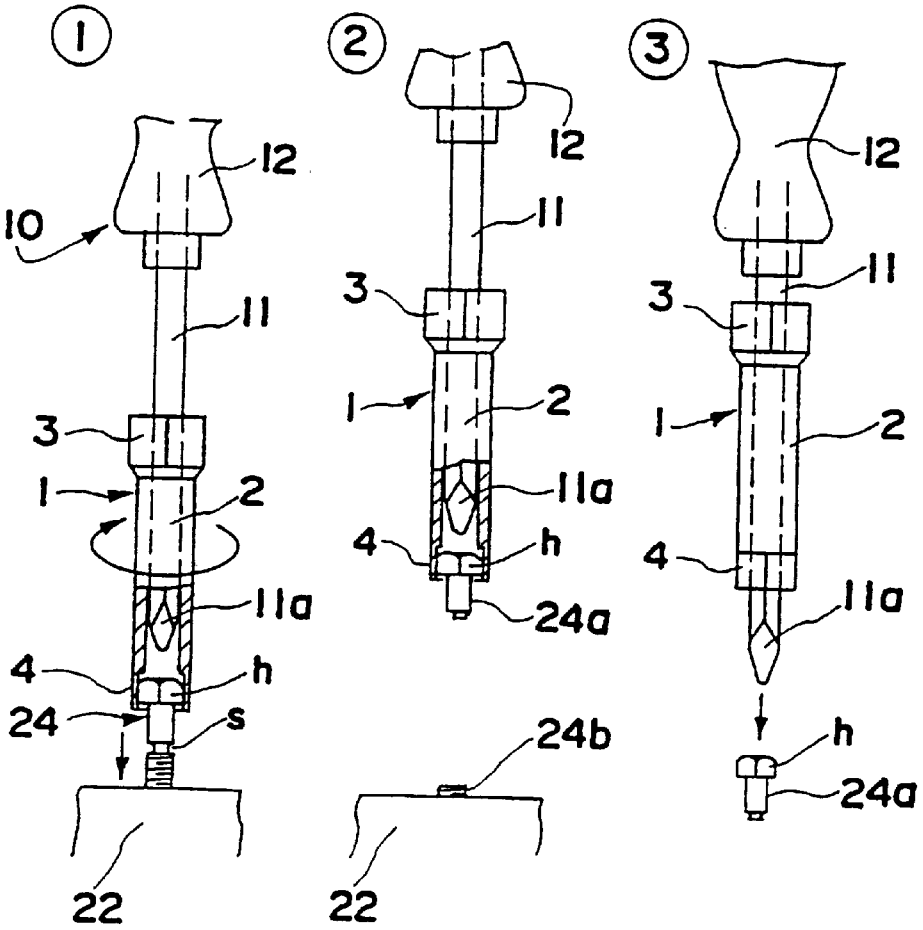
FIGS. 9(1) to 9(3) are explanatory illustrations showing bolt tightening operation, wrenching off operation and bolt head portion ejecting operation.

When the foregoing wrenching off operation of the bolt 24 is performed by the conventional socket wrench, it is frequently occurred that when the head portion side 24*a* is wrenched off by applying the wrenching off torque to the bolt 24, the bolt head h may be locked in the socket portion of the wrench. In such case, by using the driver socket 1 of the present invention, the bolt head h locked in the socket portion can be easily removed. FIGS. 9 to 9 show operations for tightening operation, wrenching off operation and removing operation of the head portion side 24*a*.

Namely, as shown in of FIG. 9, the socket portion 4 of the driver socket 1 externally fitted on the driver bit 11 engaged with the head portion h of the bolt 24. By rotating the handle 12, the bolt 24 is tightened into the piping 22. After completion of fixing of the coupling 23 to the piping 22, the handle 12 is further rotated forcedly to apply the wrenching off torque to the bolt 24. Thus, as shown in of FIG. 9, the head portion side 24*a* is wrenched off to release from the threading portion 24*b*. Subsequently, in the condition, by holding the driver socket 1 on one hand, pushing or hitting the handle 12 of the driver 10 by a hammer or the like on the other hand, the bolt head portion 24*a* locked in the socket portion 4 can be pushed out as shown in of FIG. 9.

FIGS. 10 to 13 show another embodiment of the working tool according to the present invention. The socket wrench has a first socket 105 mounted on a socket arm 103 projected on the tip end of a handle 101 for performing rotating operation and having socket holes 103 and 104 of mutually different diameters at both ends, a second socket 108 inserted within the first socket 105 in non-rotatable and axially slidable fashion and having socket holes 106 and 107 of mutually different diameters at both ends, and engaging means 109 for holding the second socket 108 at a first position, at which both of the socket holes 106 and 107 of the second socket 108, a second position, at which one of the socket hole 103 of the first socket 105 can be used, and a third position, at which the other of the socket hole 104 of the first socket 105 can be used.

The socket hole 103 on the side of one end portion 105*a* of the first socket 105 is greater than the socket hole 104 on the side of the other end portion 105*b*. On the other hand, the socket hole 106 on the side of one end portion 108*a* of the second socket 108 is smaller than the socket hole 104 on the side of small diameter (on the side of the other end portion 105*b*) of the first socket 105 and greater than the socket hole 107 on the side of the other end portion 107*b* of the second socket 108. Thus, exemplifying sizes of the nuts corresponding to the socket holes 103, 104, 106 and 107, the socket hole 103 on the side of one end portion 105*a* of the first socket 105 is 17 mm, the socket hole 104 on the side of the other end portion 105*b* is 14 mm, the socket hole 106 on the side of one end portion 108*a* of the second socket 108 is 13 mm, the socket hole 107 on the side of the other end portion 108*b* is 10 mm. These sizes are mere examples.

Figure 10:
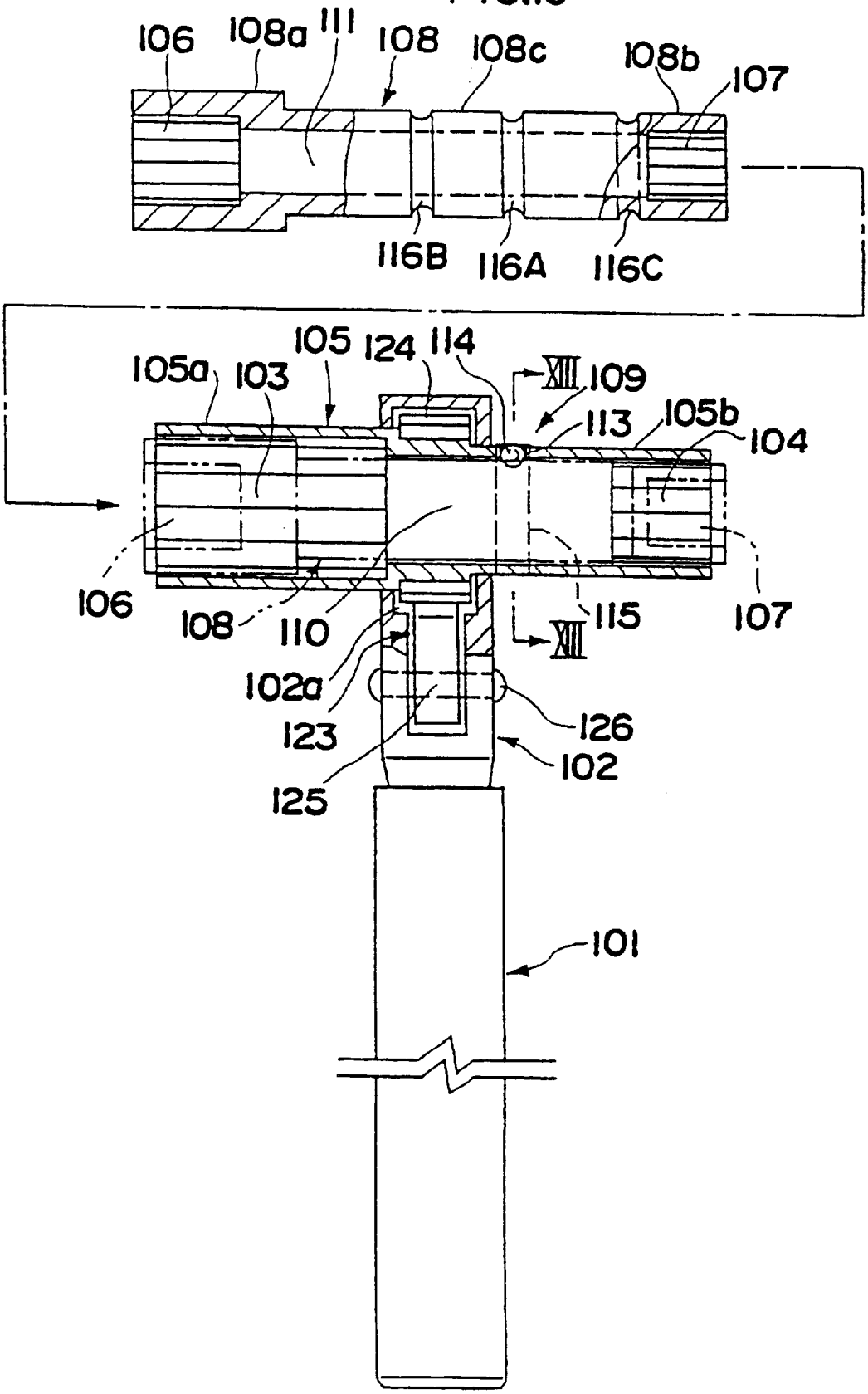
FIG. 10 is a partially sectioned side elevation showing another embodiment of the working tool according to the present invention, in which is shown a condition where a second socket and a third socket are removed from a socket hole of a first socket.

As shown in FIGS. 10 and 12(A), the first socket 105 is formed into a relatively thin cylindrical shape as a whole. On the inner periphery on the side of one end portion 105*a*, a dodecagonal socket hole 103 is formed. It should be noted that the socket hole 103 is formed longer than that of the normal socket hole as shown. As shown in FIG. 12(B), on the other end portion 105*b* of the first socket 105, the socket hole 104, inner periphery of which is dodecagonal shape, is formed. As can be appreciated from FIG. 10 and 13, between the socket hole 103 on the side of one end portion and the socket hole 104 on the side of the other end portion of the first socket 105, a sectionally circular hollow portion 110 of substantially the same internal diameter as that of the socket hole 104 is formed.

As shown in FIGS. 10 and FIG. 12(A), the outer periphery of one end portion 108*a* of the second socket 8 is larger diameter than other outer periphery portion and is formed into hexagonal shape to engage with the dodecagonal socket hole 103 on the one end portion 105*a* of the first socket in non-rotatable fashion. The inner periphery of one end portion 108*a* is formed with the dodecagonal socket hole 106. As shown in FIG. 12(B), the other end portion 108*b* of the second socket 108 is formed into hexagonal shape on the outer periphery for engaging with the dodecagonal socket hole 104 of the other end portion 105*b* of the first socket 105 in non-rotatable fashion and is formed into dodecagonal socket hole 107 on the inner periphery. At an intermediate position between one end portion 108*a* and the other end portion 108*b* of the second socket 108 is formed into cylindrical shape of external diameter substantially equal to the other end portion 108*b* and slightly smaller than the internal diameter of the hollow portion 110 of the first socket 105. The inner periphery of the cylindrical intermediate portion 108*c* is formed with a sectionally cylindrical hollow portion 111 of substantially equal to the inner diameter of the socket hole 107 on the side of the other end portion 108*b*. On the other hand, the second socket 108 is formed to be slightly longer than the first socket 105.

Figure 11:
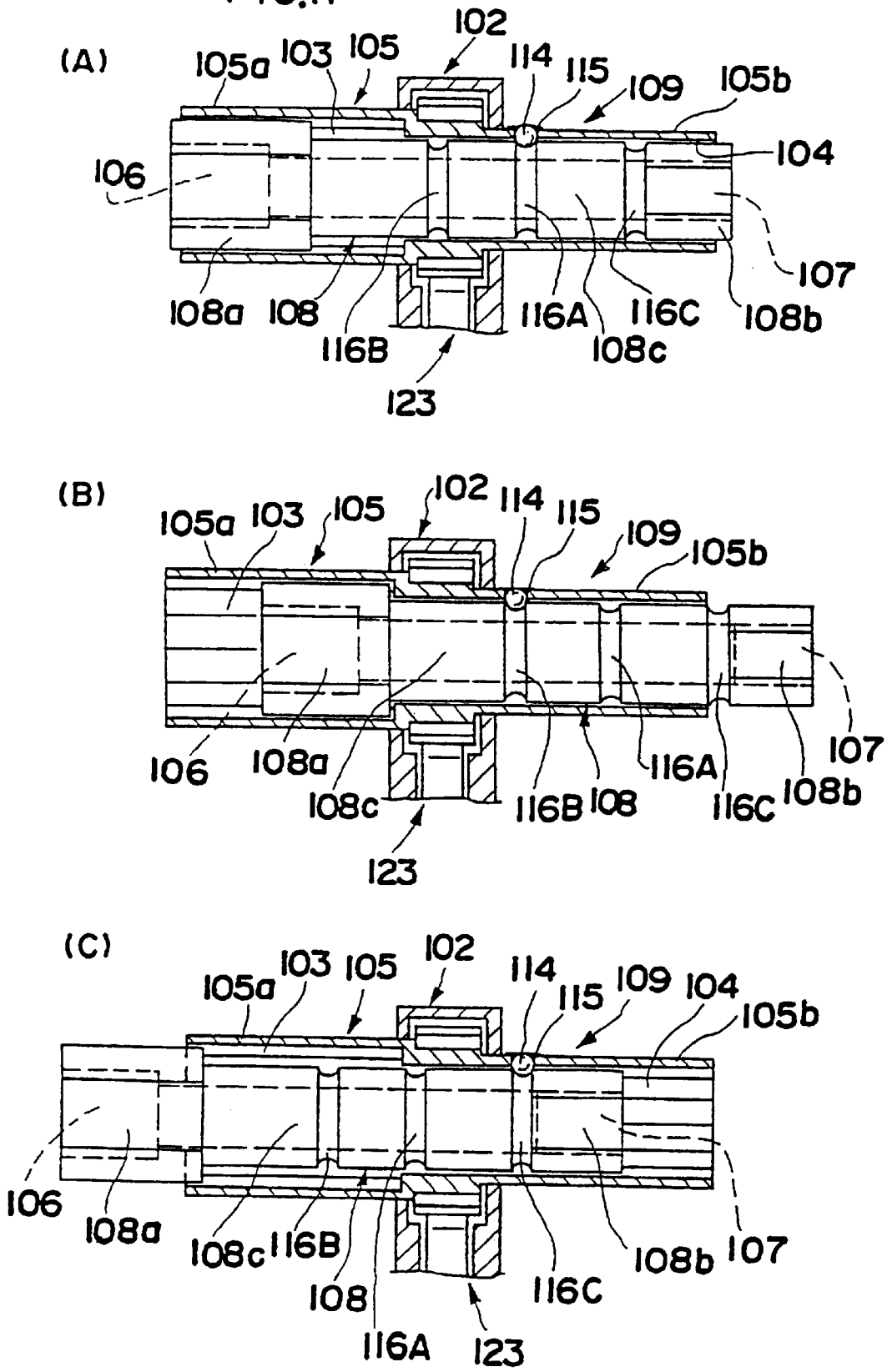
FIG. 11 is a partially sectioned enlarged side elevation showing a condition where the second socket and the third socket are engaged with the socket hole of the first socket.
Figure 12:
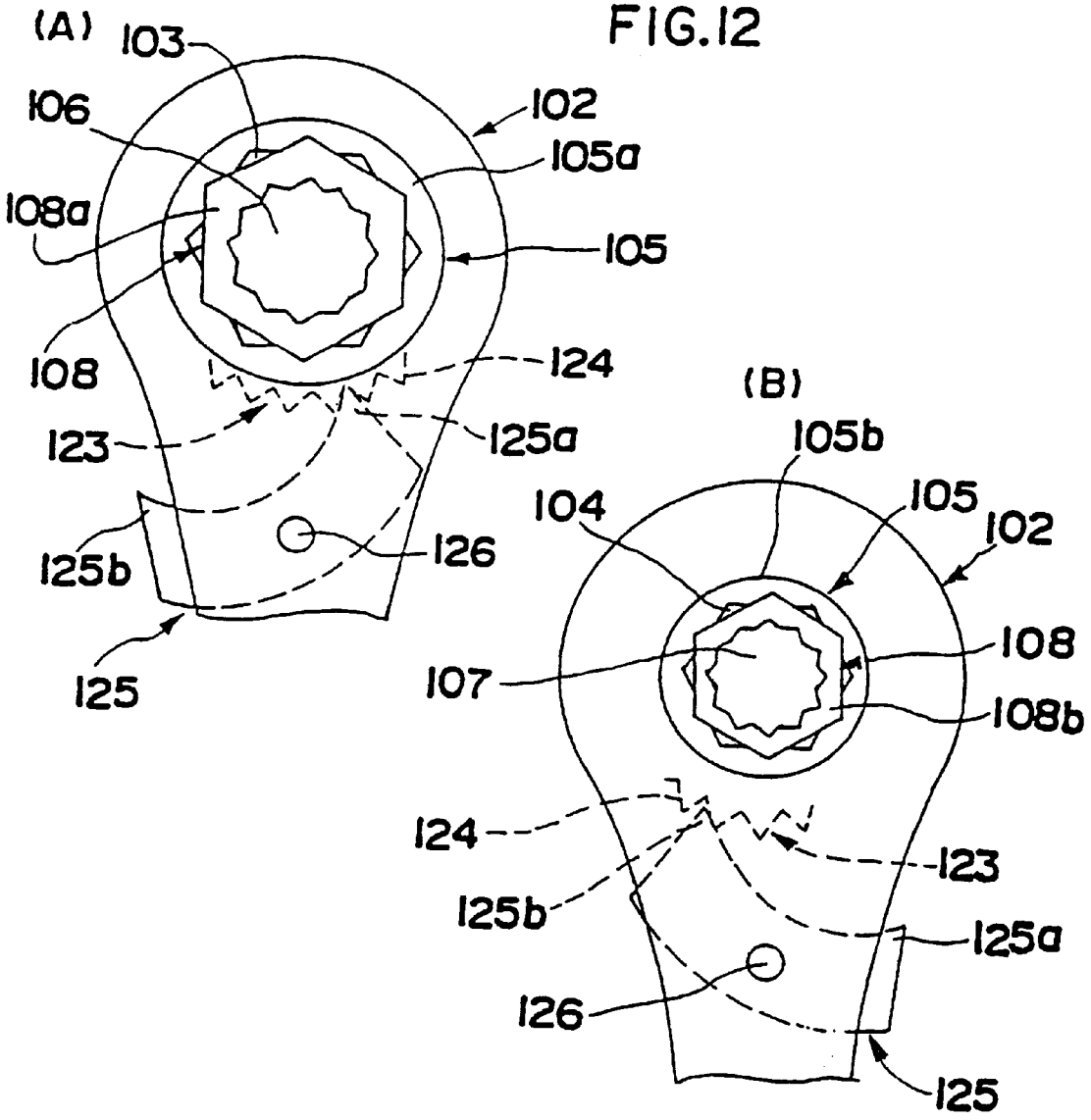
FIG. 12A is a front elevation and 12B is a back elevation.
Figure 13:
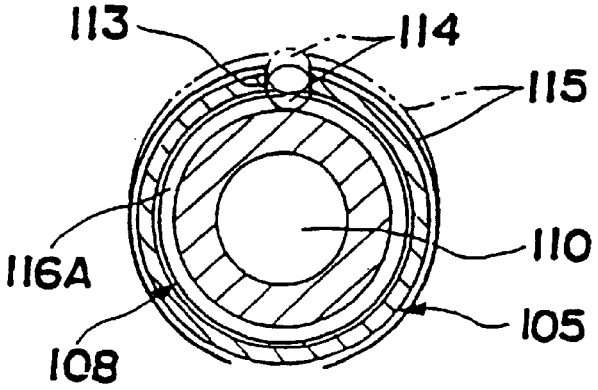
FIG. 13 is a section taken along line XIII—XIII of FIG. 11.

The engaging means 109 is adapted to hold the second socket 108 inserted into the first socket 105 for sliding in axial direction at a first position where both socket holes 106 and 107 of the second socket can be used as shown in FIG. 11(A), a second position where the socket hole 103 on the side of one end portion 105*a* of the first socket can be used as shown in FIG. 11(B), and a third position where the socket hole 104 on the side of the other end portion 105*b* of the first socket can be used as shown in FIG. 11(C), and, as shown in FIGS. 10, 12 and 13, is constructed with a spherical body 114 inserted and arranged within a window 113 provided at a predetermined position in the intermediate portion of the first socket 105, a substantially C-shaped ring like spring 115 (FIG. 3) externally fitted on the first socket 105 in the condition partly engaging with the spherical body 114 and biasing the spherical body 114 to push onto the outer peripheral surface of the intermediate portion 108*c* of the second socket 108, and a first annular groove 116A, a second annular groove 116B and a third annular groove 6C formed at positions corresponding to the first position, the second position and the third position at a predetermined internal on the outer peripheral surface of the intermediate portion 108*c* of the second socket 108.

Accordingly, when the second socket 8 is slid to the position shown in FIG. 11(A) for enabling use of both socket holes 106 and 107 of the second socket 108 which is inserted in within the first socket, the spherical body 114 engaged with the first annular groove 116A to hole the second socket 108 at the first position where both of the socket holes 106 and 107 can be used. When the second socket 108 is slid to the position shown in FIG. 11(B) for enabling use of the socket hole 103 on the side of the one end portion 105*a* of the first socket 105, the spherical body 114 engages with the second annular groove 116B to hold the second socket 108 at the second position where the socket hole 103 on the side of one end portion 105*a* of the first socket 105 can be used. When the second socket 108 is slid to the position shown in FIG. 11(C) for enabling use of the socket hole 104 on the side of the other end portion 105*b* of the first socket 105, the spherical body 114 engages with the third annular groove 116C to hole the second socket 108 at the second position where the socket hole 104 on the side of the other end portion 105*b* of the first socket 105 can be used.

It should be noted that when the second socket 108 slides into the first socket 105, the spherical body 114 rides on the outer peripheral surface of the cylindrical intermediate portion 108*c* of the second socket 108 against the biasing force of the spring 115, as shown by phantom line of FIG. 13 to be placed in projecting condition from the window 113. Thus, the spherical body 114 engages any one of the first annular groove 116A to the third annular groove 116C. Then, the spherical body 114 engages with the annular groove by the biasing force of the spring 115 to hold are respective positions of the first position, the second position and the third position.

As shown in FIG. 11(A), at the first position where both socket holes 106 and 107 of the second socket 108 can be used, both ends of the second socket 108 are placed at a position slightly projecting from both ends of the first socket 105. Then, at the first position, by using any one of the socket holes 106 and 107 of the second socket 108, the bolt and nut can be engaged and disengaged. At the second position where the socket hole 103 on the side of the one end portion 105*a* of the first socket 105 shown in FIG. 11(B) can be used, since the other end portion 108*b* of the second socket 108 is projected from the other end portion 105*b* of the first socket, at the second position, the socket hole 107 of the second socket 108 can also be used together with the socket hole 103 of the first socket 105.

On the other hand, at the third position where the socket hole 104 on the side of the other end portion 105*b* of the first socket 105 as shown in FIG. 11(C), one end portion 108*a* of the second socket 108 is projected from the one end portion 105*a* of the first socket 105. Therefore, at the third position, the socket hole 106 of the second socket 108 can be used together with the socket hole 104 of the first socket 105. It should be noted that one end portion 108*a* of the second socket 108 is placed in the condition where the its inner end portion engages with the socket hole 103 on the side of one end portion of the first socket 105 as shown. Therefore, use of the socket hole 104 or the socket hole 106 can be done in stable condition at the third position.

In FIGS. 10 to 12, the reference numeral 123 denotes a known latchet mechanism. As can be appreciated from FIG. 10, the latchet mechanism 123 is constructed by externally fitting and securing a latchet wheel 124 on the center portion of the first socket 105 within the hollow portion 102*a* of the socket arm 102, pivotably supporting a rotary claw 125 formed with claws 125*a* and 125*b* at both ends within the hollow portion 102*a* by a pin 126 as shown in FIGS. 12(A) and 12(B) and engaging the claw 125*a* with the latchet wheel 124 by pushing one end of the rotary claw 125 through one of opening windows (not shown) in the hollow portion 102*a* for permitting the latchet wheel 124 to rotate in one direction, or by engaging the claw 125*b* with the latchet wheel 124 by pushing the other end of the rotary claw 125 through the other opening window for permitting the latchet wheel to rotate in reverse direction. By this, through the latchet wheel 124, the first socket 105 is permitted to rotate in either one of forward and reverse direction.

In the embodiments set forth above, the engaging portion 109 is constructed with the spherical body 114 arranged at the predetermined position of the intermediate portion of the first socket 105, the substantially C-shaped spring 115 biasing the spherical body 114 onto the outer peripheral surface of the second socket 108, and the first annular groove 116A, the second annular groove 116B and the third annular groove 116C respectively provided on the outer peripheral surface of the second socket 108 at the first position, the second position and the third position. However, the engaging means may be one, in which an O ring is interposed between the inner peripheral surface of the first socket 105 and the outer peripheral surface of the second socket 108 to appropriately hold the second socket at the first position to the third position by a friction force by the O ring.

On the other hand, in this embodiment, while discussion 5 has been given for the socket wrench having the engaging means 109, the socket wrench of the present invention is not necessarily provided the engaging means 109. It can be merely insert the second socket 108 within the first socket 105 in non-rotatable and in axially slidable fashion.

INDUSTRIAL APPLICABILITY

As can be clear from the foregoing discussion, the working tool according to the present invention, can be used conveniently by mounting on typical driver, such as the fixed type driver, in which the handle is integrally mounted on the driver bit, the exchangeable type driver , in which the driver bit is detachably mounted on the handle. Furthermore, since the construction is simple and formed with a single hollow shaft body, it can be manufactured in low cost, and is convenient for porting.

I claim:

1. A socket tool for use alternatively in combination with an internal driver, or an external wrench, which comprises (a) a socket body formed centrally with an internal configuration adapted to fit externally over a driver bit of a driver device, (b) said internal configuration conforming to external configurations of said driver bit to accommodate movement of said socket body axially along said driver bit and detachment therefrom while preventing rotation of said socket body relative to said driver bit, (c) said socket body having socket portions at opposite ends thereof formed internally into regular polygonal cross sectional shapes of different internal dimensions at said opposite ends, (d) outer peripheries of said opposite end socket portions being formed externally, at opposite end extremities of said socket body, into regular polygonal cross sectional shape and serving as external drive engaging faces to be engaged externally by a wrench, (e) said socket portions having different external dimensions at each end, (f) said socket tool being engaged alternatively internally, by the driver bit, or externally at its end extremities, by a wrench, with the other socket portion being projected longitudinally away from such driver bit or wrench.

2. A socket tool according to claim 1, wherein (a) the driver bit has an engaging recess formed on the outside thereof, (b) said socket body has an engaging means therein engageable with said engaging recess, so that the socket tool is held on the driver bit, (c) the engaging recess and the engaging means being so arranged that either of said socket portions are projected longitudinally from the driver bit when the socket body is fitted thereon.

3. A socket tool according to claim 1, wherein (a) said engaging means comprises a window provided in said socket body at a predetermined position between ends thereof, (b) a spherical body is positioned within said socket body, and (c) a spring biases said spherical body to project inwardly from said window and thereby engage with said engaging recess when said socket body is fitted on said driver bit.

* * * * *